United States Patent [19]

Saunders et al.

[11] 4,338,790

[45] Jul. 13, 1982

[54] CONTROL AND METHOD FOR DEFROSTING A HEAT PUMP OUTDOOR HEAT EXCHANGER

[75] Inventors: James F. Saunders, Onalaska; Robert E. Krocker, Stoddard, both of Wis.

[73] Assignee: The Trane Company, La Crosse, Wis.

[21] Appl. No.: 123,308

[22] Filed: Feb. 21, 1980

[51] Int. Cl.[3] ..... F25D 21/00

[52] U.S. Cl. ..... 62/80; 62/156

[58] Field of Search ..... 62/80, 128, 140, 156, 62/151

[56] References Cited

U.S. PATENT DOCUMENTS

| | | | |
|---|---|---|---|
| 2,847,190 | 8/1958 | Slattery et al. | 62/156 X |
| 3,125,862 | 3/1964 | Gould | 62/156 |
| 3,170,304 | 2/1965 | Hale | 62/155 |
| 3,170,305 | 2/1965 | Dibble et al. | 62/155 |
| 3,777,505 | 12/1973 | Otaki | 62/156 X |
| 3,950,962 | 4/1976 | Odashima | 62/156 |
| 4,102,391 | 7/1978 | Noland et al. | 62/156 |
| 4,209,994 | 7/1980 | Mueller et al. | 62/156 |

OTHER PUBLICATIONS

Product Description, *Honeywell Advanced Heat Pump Control System,* Honeywell Inc.,Bulletin #71-5100, 1979.

*Primary Examiner*—Albert J. Makay

*Assistant Examiner*—Harry Tanner

*Attorney, Agent, or Firm*—Carl M. Lewis; Peter D. Ferguson; Ronald M. Anderson

[57] ABSTRACT

A control and method for defrosting the outdoor heat exchanger of an air source heat pump. A defrost cycle is initiated when ice and frost have accumulated on the outdoor heat exchanger sufficiently such that, as a function of the indoor temperature of a comfort zone, the maximum permissible heat transfer degradation at which the efficiency and reliability of the temperature conditioning system are optimized, has occurred. Heat transfer degradation is determined from the outdoor ambient air temperature and the temperature of either the outdoor heat exchanger, or the compressor suction line. If the temperature of the outdoor heat exchanger or the suction line is less than a predetermined value, a deferred defrost cycle is initiated wherein the defrost cycle starts after a fixed time interval has elapsed.

The defrost cycle is terminated when the relative temperatures of the outdoor heat exchanger and the outdoor ambient air indicate that sufficient frost is melted from the heat exchanger to insure adequate time between successive defrost cycles for optimizing the efficiency and reliability of the system, or after a predetermined time interval has elapsed, whichever condition occurs first.

20 Claims, 3 Drawing Figures

CONTROL AND METHOD FOR DEFROSTING A HEAT PUMP OUTDOOR HEAT EXCHANGER

TECHNICAL FIELD

This invention generally pertains to a method and control for defrosting an outdoor heat exchanger and specifically, to a method and control for defrosting the outdoor heat exchanger of an air source heat pump, in a manner which optimizes the efficiency and reliability of the temperature conditioning system.

BACKGROUND ART

During operation in the heating mode, the outdoor heat exchanger of an air source heat pump provides means to vaporize a refrigerant liquid by heat transfer from air flowing through the heat exchanger. Efficient operation of the system requires that sufficient heat be transferred from the air flowing through the outdoor heat exchanger to maintain adequate capacity to meet the heating demand in a comfort zone.

If the outdoor ambient air temperature is less than approximately 32° F., frost and ice may accumulate on the heat exchanger, blocking air flow therethrough to such an extent that its capacity for heat transfer is reduced below that required to meet the heating demand in the comfort zone. It is therefore common practice to defrost the outdoor heat exchanger, melting the accumulated frost and ice, to prevent an unacceptable level of heat transfer degradation.

One of the simplest methods of preventing excessive frost accumulation on the outdoor heat exchangers is to initiate a defrost cycle at timed intervals. A control for such a time-based defrost method should provide for a relatively long interval between defrost cycles at low ambient air temperatures. At outdoor ambient air temperatures less than 0° F., the relative humidity is usually close to 100%; yet, at these temperatures, the volume of water vapor per unit volume of air is relatively low. As a result, it takes longer for frost to accumulate on an outdoor heat exchanger than it does at higher ambient air temperatures. Since the defrost cycle typically wastes energy, it should not be implemented more often, nor for a longer period than necessary to maintain the required capacity. It is thus preferable to initiate a defrost cycle only after sufficient ice and frost have formed on the outdoor heat exchanger to cause a problem in meeting the heating demand.

There are numerous techniques in the prior art for sensing an accumulation of frost on the outdoor heat exchanger, as for example, detecting a reduction in air flow through the heat exchanger, or the scattering of a reflected light beam by frost crystals. Such techniques provide little more than an indication that frost has formed and that heat transfer is at least partially degraded thereby. More sophisticated techniques provide means for sensing the extent of heat transfer degradation due to frost accumulation, e.g., by the relationship of the outdoor ambient air temperature and the outdoor heat exchanger temperature.

If the indoor or comfort zone setpoint temperature remains constant, such techniques may provide efficient, reliable defrost cycle operation. However, if the setpoint temperature in a comfort zone is changed significantly, as for example due to night setback, the prior art defrost controls do not provide means to compensate for the change in the minimum required heating capacity to meet the demand. As a result, the defrost cycle is not controlled with optimum efficiency and reliability.

It is therefore an object of this invention to provide a method and control for defrosting an outdoor heat exchanger, which optimizes efficiency and reliability of the temperature conditioning system as a function of the comfort zone temperature.

Another object of this invention is to control the defrost cycle in a manner which compensates for a change in the required heating capacity due to a change in the comfort zone setpoint temperature.

It is a further object of this invention to terminate the defrost cycle as soon as a sufficient quantity of ice and frost accumulated on the outdoor heat exchanger have melted to resume reliable and efficient operation of the heat pump system.

A still further object of this invention is to provide means to initiate a deferred defrost cycle, if the relative water vapor content of the outdoor ambient air is so low that frost and ice accumulate on the outdoor heat exchanger very slowly.

These and other objects of the subject invention will become apparent from the description which follows and by reference to the attached drawings.

DISCLOSURE OF THE INVENTION

The subject invention is a control for defrosting an outdoor heat exchanger of a heat pump system for temperature conditioning a comfort zone. The heat pump further includes an indoor heat exchanger, a compressor connected to a reversing valve by a refrigerant suction line, and means for moving air through the indoor and outdoor heat exchangers in heat transfer relation therewith.

The control comprises sensors for sensing the temperature of the comfort zone, the suction line temperature, the outdoor heat exchanger temperature and the temperature of the outdoor ambient air. Control means are responsive to these temperature sensors and are operative to initiate a defrost cycle to melt ice and frost accumulated on the outdoor heat exchanger, as a function of the temperature of the comfort zone and the degradation of heat transfer in the outdoor heat exchanger. The control means determine the maximum permissible degradation of heat transfer at which the defrost cycle should be initiated to optimize the efficiency and reliability of the heat pump system, as a function of the outdoor heat exchanger or suction line temperature, the temperature of the comfort zone, and the outdoor ambient air temperature; and initiate the defrost cycle accordingly.

The defrost cycle is terminated by the control means, if the temperature of the outdoor heat exchanger exceeds a value determined by the control means as a function of the outdoor ambient air temperature, or after a predetermined time interval has elapsed.

The control means are responsive to means for sensing a condition indicative of the water vapor content of the outdoor ambient air, and are operative to initiate a deferred defrost cycle, wherein the defrost cycle is deferred for a fixed time interval if the condition sensed indicates that the water vapor content of the outdoor ambient air is relatively low.

Methods for effecting the functions provided by the above-described control are a further aspect of this invention.

DESCRIPTION OF THE PREFERRED EMBODIMENT

Figure 1:
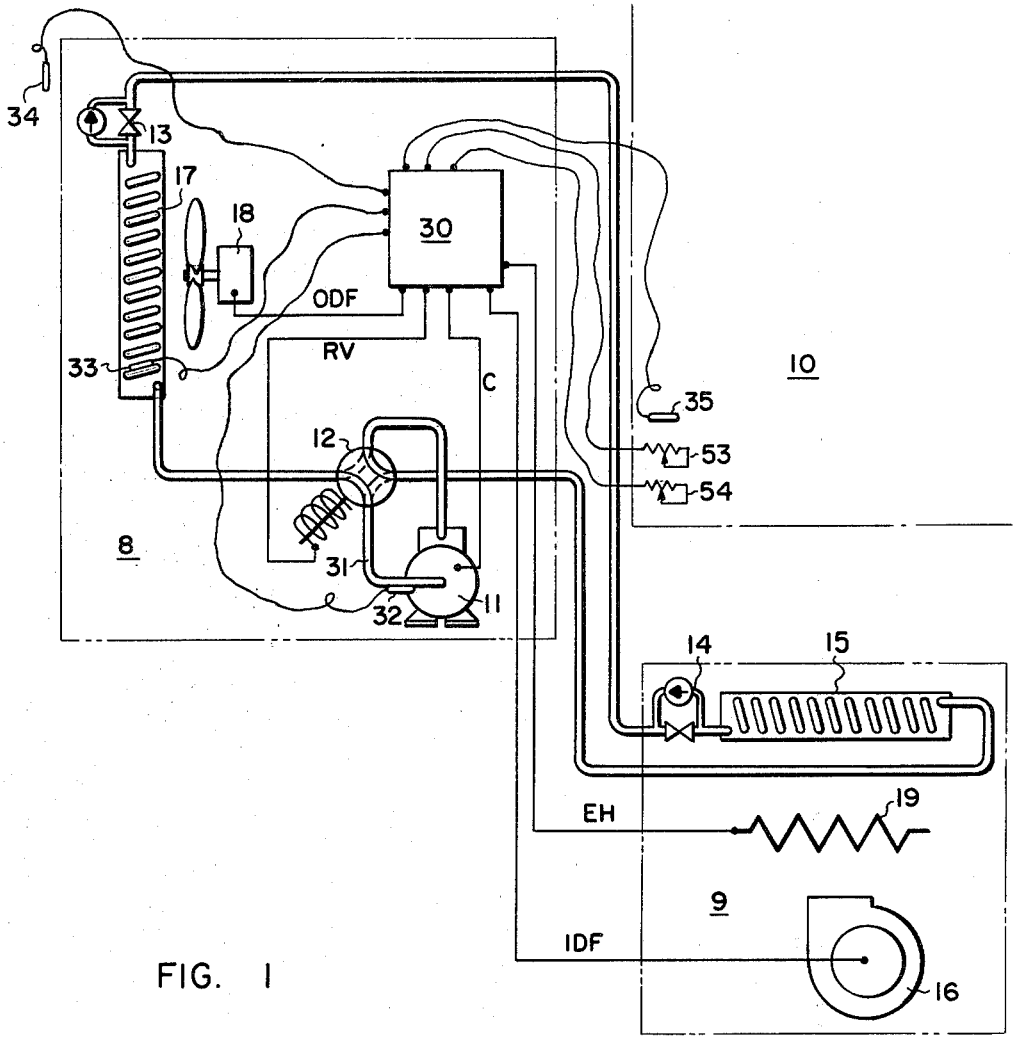
FIG. 1 is a block diagram showing the subject invention configured with an air source heat pump.

With reference to FIG. 1, a generally conventional air source heat pump is shown configured with an outdoor unit 8 and an indoor unit 9. Although shown in block diagram format, it will be understood that the indoor unit 9 of the heat pump system is arranged to provide temperature conditioned air to a comfort zone 10. The heat pump comprises a refrigerant vapor compressor 11, coupled to a reversing valve 12, and expansion/bypass valves 13 and 14 are provided such that the heat pump system can be selectively operated to either heat or cool air circulated through the comfort zone 10 by an indoor fan 16. The heat pump system further includes indoor heat exchanger 15, outdoor heat exchanger 17, and outdoor fan 18. Electric heat elements 19 are provided as an auxiliary heat source for heating the comfort zone 10.

During operation in the heating mode, refrigerant vapor is compressed by compressor 11, passes through reversing valve 12 and into the indoor unit 9, where it is condensed in the indoor heat exchanger 15 by heat transfer with air circulated into the comfort zone 10 by indoor fan 16. The condensed refrigerant liquid bypasses through expansion/bypass valve 14 and expands through expansion/bypass valve 13 into the outdoor heat exchanger 17. The outdoor fan 18 moves outdoor ambient air through the outdoor heat exchanger 17 such that the refrigerant liquid is vaporized as it absorbs heat from the air. The refrigerant vapor thereafter returns through reversing valve 12 to the inlet of compressor 11.

While operating in the heating mode, the capacity and efficiency of an air source heat pump is significantly reduced when the outdoor ambient air temperature is relatively low. It is therefore common practice to supply auxiliary heating stages to supplement the heating capacity of the heat pump under these conditions. In the preferred embodiment, electric heating elements 19 are disposed to heat air circulated into the comfort zone 10 by the indoor fan 16. Although only a single heating element 19 is diagrammatically shown in FIG. 1, this should be considered as representative of one or more stages of electric heat, each stage capable of being selectively energized.

Air supplied to the comfort zone 10 may be selectively cooled rather than heated, by operation of the reversing valve 12, which interchanges the functions of the indoor and outdoor heat exchangers 15 and 17, respectively. In the cooling mode, the outdoor heat exchanger 17 serves as a condenser to condense the compressed refrigerant vapor supplied by compressor 11. The condensed liquid bypasses through expansion/-bypass valve 13 and expands through expansion/bypass valve 14 into the indoor heat exchanger 15. The refrigerant liquid is vaporized in heat transfer relationship with air circulated into the comfort zone 10 by the indoor fan 16, thereby cooling the air. The vaporized refrigerant returns to the compressor 11, to repeat the cycle.

Operation of the components heretofore described is controlled by unit controller 30, which comprises the control means of the subject invention. Unit controller 30 is able to selectively energize and de-energize each of these components comprising the heat pump system, by controlling the supply of electrical power to the components. The power supply control lines for these components are labeled in FIGS. 1 and 2 as follows: compressor 11, C; electric heat elements 19 (one or more stages), EH; reversing valve 12, RV; indoor fan 16, IDF; and outdoor fan 18, ODF.

Unit controller 30 is also connected to thermistors 32, 33, 34, and 35, for sensing temperature at various locations. Thermistor 32 is disposed on suction line 31, connecting the reversing valve 12 with the inlet to compressor 11, and is operative to sense the suction line temperature. Thermistor 33 is in contact with the coils of outdoor heat exchanger 17 and therefore senses its temperature. Thermistors 34 and 35 are disposed to sense the outdoor ambient air temperature and the comfort zone temperature, respectively.

The subject invention is directed to the problems associated with defrosting the outdoor heat exchanger 17 to melt ice and frost which have accumulated thereon during operation of the heat pump system in the heating mode. Unit controller 30 includes control means responsive to thermistors 32–35 for effecting control of the defrost cycle, as claimed herein, and in addition, controls the apparatus of the outdoor unit 8 and indoor unit 9 during normal operation of the heat pump. In the preferred embodiment, the defrost cycle is initiated when unit controller 30 de-energizes the outdoor fan 18, and energizes the reversing valve 12, thereby interchanging the functions of the indoor and outdoor heat exchangers 15 and 17, respectively. Under these conditions, compressed hot refrigerant vapor is supplied to the outdoor heat exchanger 17 to melt the ice and frost accumulated thereon. During the defrost cycle, the indoor heat exchanger 15 cools air supplied to the comfort zone 10 even though there is a demand for heat; however, unit controller 30 energizes electric heat as required to meet the heating demand. In the prior art, it is common for all stages of electric heat to be energized during the defrost cycle regardless of heating demand; the present system selectively energizes each stage of electric heat 19, as required.

Figure 2:
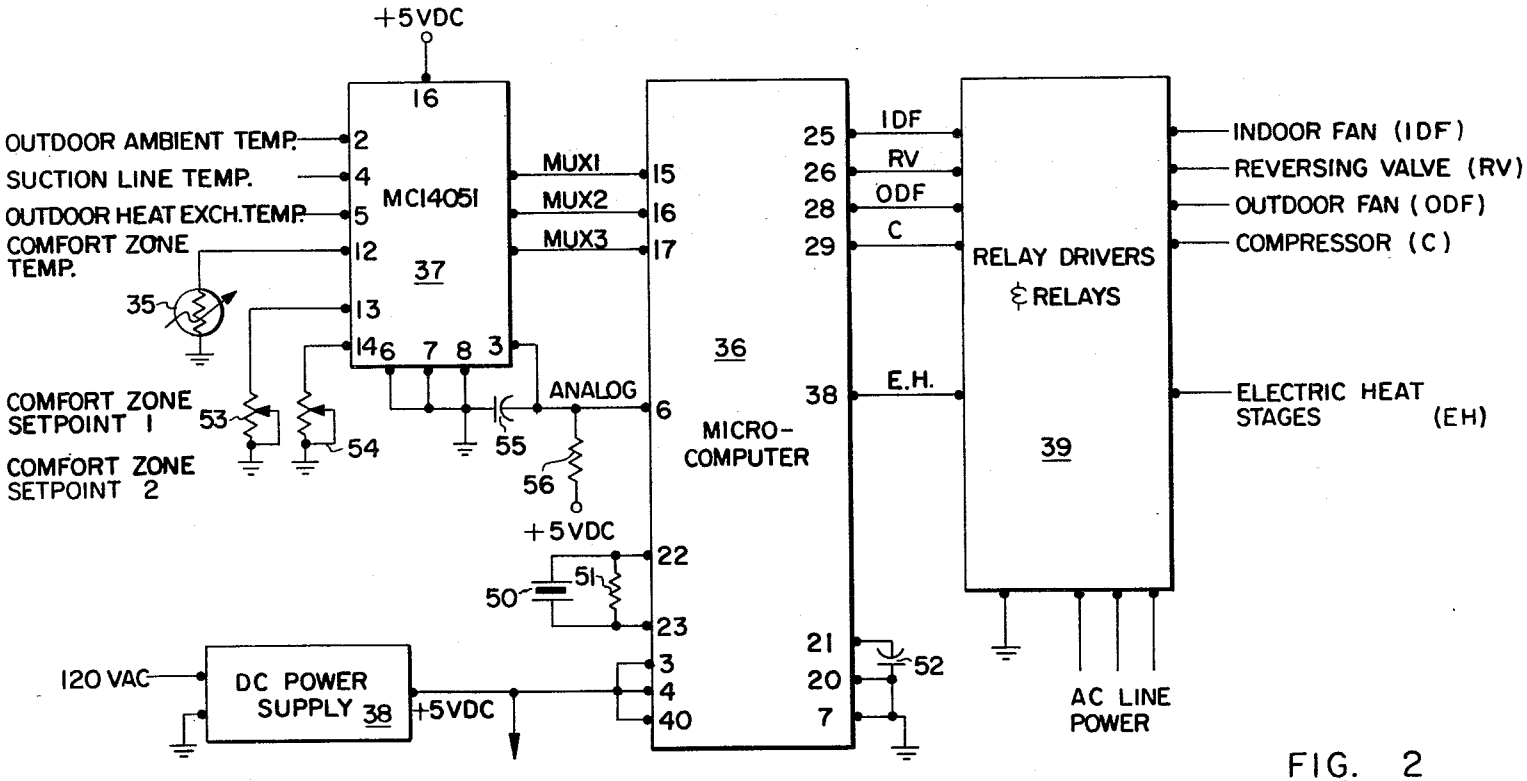
FIG. 2 is a schematic diagram of the control circuitry of the subject invention.

Referring now to FIG. 2, a block diagram of unit controller 30 is shown comprising a microcomputer 36, multiplexor input chip 37, DC power supply 38, and relay driver/relay board 39. Microcomputer 36 is connected by logic level control lines to the relay driver board 39, and is thereby operative to selectively energize the components of the heat pump system shown in FIG. 1, via the electrical power supply lines labeled as explained above. Microcomputer 36 includes a central processing unit (CPU), a read-only memory (ROM), a random access memory (RAM), an internal timer/-counter, and an analog-to-digital (A-D) convertor. In the preferred embodiment, microcomputer 36 is an Intel, type 8022 large scale integrated circuit, specifically selected for its on-chip analog-to-digital capability. A microcomputer without A-D convertor, but otherwise similar, and an external 8 bit A-D convertor chip would be equally suitable for carrying out the subject invention. The DC power supply 38 is of generally conventional design, and provides a regulated 5 volts DC to power the microcomputer 36 and the other components connected to the +5 volt DC bus of unit controller 30. The relay driver board 39 is also of a conventional design well known to those skilled in the art, and includes solid stage switching to energize selected relay coils in response to logic level signals from microcomputer 36, thereby controlling relay contacts for energizing the selected connected loads with AC line power.

A quartz crystal 50, connected in parallel with resistor 51, provides a stable time base for microcomputer 36. Typically, a 3.6 megaHertz crystal would be used for this purpose. Capacitor 52 is connected to microcomputer 36 to stabilize its substrate voltage, and to improve its A-D conversion accuracy.

Input multiplexor chip 37 is connected to microcomputer 36 via three control lines, labeled MUX1, MUX2, and MUX3. Multiplexor 37 receives a digital select code from microcomputer 35 via control lines MUX1 through MUX3, decodes that information, and provides the selected analog signal on an "ANALOG" signal line, as input to the built-in A-D converter of microcomputer 36. Input multiplexor 37, in the preferred embodiment, is a Motorola Corporation integrated circuit, type MC 14051; other similar multiplexors would be equally suitable. Analog signal inputs are provided to input multiplexor 37 from the temperature sensors, i.e., thermistors 32–35, and from adjustable resistors 53 and 54, which are disposed in the comfort zone. Adjustable resistors 53 and 54 would typically be co-located with the comfort zone temperature sensor, thermistor 35, and provide the means for manually determining a first setpoint temperature for normal operation of the heat pump system, and a second setpoint temperature for operation of the heat pump system at a more economical level. For example a higher setpoint 1 might be used during the day, and a lower setpoint 2 (or setback) used at nighttime, after the occupants of comfort zone 10 had retired. Clock means for enabling the particular setpoint 1 or 2, to which the unit controller 30 would respond are not shown, since they are not the subject of nor required to implement this invention; however, such clock means might include a clock driven timer disposed in the comfort zone, or a programmed timer enabled by software in microcomputer 36, as will be apparent to those skilled in the art.

Pull-up resistor 56 is connected to the ANALOG input line of microcomputer 36 and to the +5 volt DC bus. When input multiplexor chip 37 connects a selected analog input to the ANALOG input line of microcomputer 36, the voltage which appears on the ANALOG input line is proportional to the resistance to ground of the selected input. The analog-to-digital convertor included in microcomputer 36 converts that analog voltage level into a digital value for use by microcomputer 36 in implementing the control logic. Capacitor 55 is connected between the ANALOG input line and ground and is used to filter electrical signal noise which may appear thereon.

Figure 3:
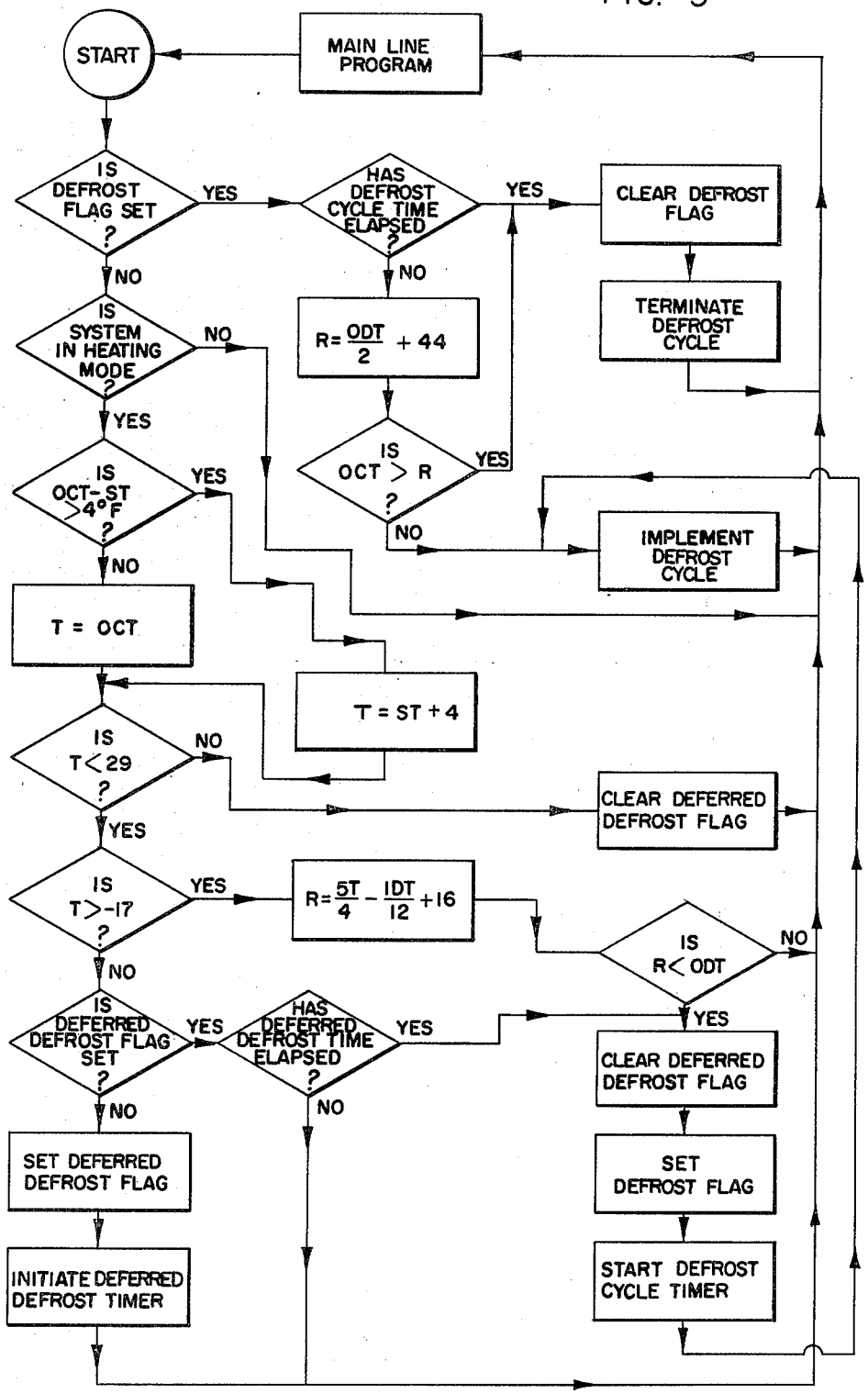
FIG. 3 is a flow chart illustrating the control logic for implementing the subject invention.

A flow chart illustrating the control logic for implementing the functions of the subject invention is shown in FIG. 3. Microcomputer 36 contains the machine language instructions stored in read-only-memory (ROM) for carrying out each step shown in the flow chart. Normal operation of the heat pump system in maintaining the comfort zone 10 at the selected setpoint temperature is controlled by logic steps not specifically shown in the flow chart but instead indicated by a block labeled "MAIN LINE PROGRAM." The control logic of the subject invention may be considered as a subroutine which is entered from the main line program at regular intervals-in the preferred embodiment, approximately every five seconds. Unless the conditions under which the defrost cycle should be initiated occur, as will be described hereinbelow, microcomputer 36 continues to control the components of the heat pump system in accord with the machine language instruction stored in ROM, and labeled as MAIN LINE PROGRAM.

In implementing the defrost control subroutine logic, microcomputer 36 first determines if a defrost flag had been set during a prior cycle through the subroutine. Those skilled in the art will understand that a flag is merely a status indication, stored as a binary bit in a register or in random access memory. If the defrost flag is set, it indicates that the defrost cycle has been initiated.

Assuming that the defrost flag is not set, microcomputer 36 next determines if the heat pump system is in the heating mode. If the system is not in the heating mode, the outdoor heat exchanger 17 will not require defrosting, and control therefore reverts to the MAIN LINE PROGRAM. If the heating mode is active, microcomputer 36 determines if the outdoor heat exchanger coil temperature is more than 4° warmer than the suction line temperature. It should be clear that in order to do this, microcomputer 35 causes the multiplexor input chip 37 to select the outdoor heat exchanger temperature as an input, performs an A-D conversion, selects the suction line temperature as an analog input, performs another A-D conversion, and from these two digital values, makes a logic decision regarding their relative magnitude. It has been experimentally determined for a particular design of heat pump, that the suction line temperature is approximately 4° F. colder than the outdoor heat exchanger temperature during normal operation. A value T is thus set equal to the colder of the outdoor heat exchanger temperature (OCT) and the sum of the suction line temperature plus 4° F. It is possible, that in a heat pump of different design, the suction line temperature should be adjusted by some value other than 4° F. to compensate for differences between the outdoor heat exchanger temperature and the suction line temperature in determining the proper point to initiate the defrost cycle.

The control logic then determines if the value T is less than 29° and greater than −17° F. If T is not less than 29° F., ice and frost will not have accumulated on the outdoor heat exchanger in sufficient quantities to require initiation of a defrost cycle; therefore control is returned to the MAIN LINE PROGRAM after insuring that the deferred defrost flag (if previously set) is cleared. If T is less than 29° F. and greater than −17° F., microcomputer 36 determines the value of a function R from the mathematical relationship $R=5T/4-IDT/12+16$. In this equation, IDT is the temperature of the comfort zone 10, as determined by the comfort zone temperature sensor, thermistor 35. Microcomputer 36 selects this input via multiplexor chip 37, as described above. Similarly, microcomputer 36 selects the outdoor ambient air temperature for A-D conversion, for use in the next control logic decision. In that decision, microcomputer 36 determines if the computed value of the function R is greater than the outdoor ambient air temperature (ODT). If so, control is returned to the MAIN LINE PROGRAM; otherwise, microcomputer 36 clears the deferred defrost flag (if set during a prior cycle thorugh the subroutine), sets the defrost flag, starts the defrost cycle timer, and initiates the defrost cycle, before returning to the MAIN LINE PROGRAM.

If T is less than −17° F., the water vapor content of the outdoor ambient air is so low that the defrost cycle should be deferred for a relatively long time interval. In this case, microcomputer 36 checks to determine if a deferred defrost flag has already been set; and if not, sets the deferred defrost flag and initiates the deferred defrost timer. This deferred defrost timed interval is programmed to utilize the timer/counter function included in the microcomputer 36, in a manner well known to those skilled in the art. After the deferred defrost timer is initiated, control reverts to the MAIN LINE PROGRAM. In the preferred embodiment, the deferred defrost timer interval lasts for 256 minutes, and so long as the temperature conditions do not change such that T becomes greater than −17°, the defrost cycle cannot be initiated until the expiration of that deferred defrost time interval. On successive cycles through the defrost subroutine after the deferred defrost flag has been set, the microcomputer 36 determines if the deferred defrost time has elapsed, and if not, control reverts to the MAIN LINE PROGRAM. However, if the deferred defrost time interval has elapsed, such that 256 minutes have passed since the deferred defrost timer was first started, the control logic clears the deferred defrost flag, sets the defrost flag, and starts the defrost cycle timer. The defrost cycle timed interval also uses the timer/counter included in microcomputer 36. After starting the defrost cycle timer, microcomputer 36 initiates the defrost cycle as described above, and then returns to the MAIN LINE PROGRAM. Once the defrost cycle is initiated, the MAIN LINE PROGRAM meets the heating demand in comfort zone 10, by selectively energizing electric heat elements 19, as required. Likewise, if the value of T should become greater than −17° F. on a successive cycle through the defrost control subroutine after the deferred defrost timer has been initiated, microcomputer 36 determines the value R, and may initiate the defrost cycle before the deferred defrost time has elapsed if R is less than the outdoor ambient air temperature.

The function R has been determined from empirical data and computer modeling analyses of a particular heat pump system as best describing the relationship between the indoor temperature, the outdoor heat exchanger temperature or suction line temperature, and the outdoor ambient air temperature for determining the initiation of the defrost cycle to optimize the efficiency and reliability of that heat pump system. The empirical data and computer modeling analyses were specifically developed for a 3 ton heat pump, but are believed to be equally applicable to similarly designed heat pump systems of different capacity. The relationship of the temperatures used to determine R will be further discussed hereinbelow.

On successive cycles through the defrost control subroutine after the defrost flag is set, microcomputer 36 checks to determine if the defrost cycle timed interval has elapsed. In the preferred embodiment, the defrost cycle may only continue for a maximum of 10 minutes after it is initiated. If the defrost cycle timed interval has not elapsed, microcomputer 36 computes a new function $R=0DT/2+44$. If the outdoor heat exchanger temperature is greater than the value computed for R, microcomputer 36 clears the defrost flag and terminates the defrost cycle, returning control to the MAIN LINE PROGRAM to implement normal operation of the heat pump system. Otherwise, the defrost cycle is allowed to continue.

The equation used to compute R to terminate the defrost cycle was also determined from empirical data and computer modeling analyses as best defining the relationship between the outdoor ambient air temperature and the outdoor heat exchanger temperature at which the defrost cycle should be terminated to allow sufficient time between successive defrost cycles to optimize efficiency and reliability of the heat pump system. If for some reason, such as outdoor ambient wind conditions, the defrost cycle has not terminated as a result of the relationship between these two temperatures, as a back-up, microcomputer 36 is operative to terminate the defrost cycle timed interval has elapsed.

In the preferred embodiment of the subject invention, defrost is deferred for about 256 minutes if the value T, (the substantially colder of the outdoor heat exchanger temperature and the sum of the suction line temperature and 4° F.), is less than −17° F. As discussed above, ice and frost accumulate on the outdoor heat exchanger very slowly at outdoor ambient air temperatures less than 0° F. Those skilled in the art will appreciate that an extremely low outdoor heat exchanger temperature or suction line temperature, i.e., less than −17°, would occur only when the outdoor ambient air temperature is also relatively low, i.e., less than 0° F. The deferred defrost cycle could equally well be initiated in response to the outdoor ambient air temperature, sensed by thermistor 34, for example, if ODT is less than a relatively low value, i.e., a value less than 0° F. The decision to initiate the deferred defrost cycle as a function of T rather than the ODT value was somewhat arbitrary in the preferred embodiment,—but still within the scope of the claims which follow.

The control logic may also be changed to provide for microcomputer 36 to use a value T equal to the outdoor heat exchanger temperature, rather than the colder of that temperature and the sum of the suction line temperature and 4° F. This would eliminate the need for a suction line temperature sensor, thermistor 32, and simplify the control logic shown in the flow chart, FIG. 3, by eliminating reference to the suction line temperature ST. As a further alternative, the value T may simply be set equal to the sum of the suction line temperature ST and 4°, for calculating the value R used to determine initiation of the defrost cycle. In this case, it would not be necessary to consider the temperature of the outdoor heat exchanger for purposes of calculating R. The substantially colder of the suction line temperature plus 4° F., and the outdoor heat exchanger temperature are used to determine the initiation of the defrost cycle in the control logic of the preferred embodiment as shown in FIG. 3, because this alternative is believed to provide more reliable defrost control for the particular outdoor heat exchanger assembly used on the heat pump system involved in developing the invention. All three alternatives for initiating the defrost cycle, as described above, lie within the scope of the claims which follow.

Understanding of the equations and logic used for initiating the defrost cycle is facilitated by the following explanation. As ice and frost accumulate on the outdoor heat exchanger 17, its effective area for heat transfer is reduced and the temperature of the saturated refrigerant vapor in outdoor heat exchanger 17 or suction line 31 decreases. Similarly, absent accumulation of frost and ice on the outdoor heat exchanger 17, as the outdoor ambient air temperature changes, the value for T should change in direct proportion. A decrease in T disproportionate to a decrease in the outdoor ambient air temperature indicates a decrease in heat transfer efficiency. Comparison of the relative values of the outdoor ambient air temperature and the value T therefore provide an indication of the degradation of heat transfer efficiency of the outdoor heat exchanger. Consideration of the comfort zone temperature (IDT) enables the defrost control to be fine tuned for optimum efficiency and reliability. As the comfort zone temperature is decreased, the efficiency of the temperature conditioning system becomes relatively greater due to the reduced difference between the outdoor ambient air temperature and comfort zone temperature. The control therefore initiates the defrost cycle as a function of IDT to maintain a relatively constant maximum permissible degradation of heat transfer efficiency, as the efficiency of the system changes due to changes in the comfort zone temperature.

The defrost cycle is terminated when the relative values of the outdoor ambient air temperature and the outdoor heat exchanger temperature indicate that sufficient frost and ice have been melted from the heat exchanger to continue its operation with sufficient time between successive defrost cycles to optimize efficiency and reliability. It should be apparent that it is not necessary to melt all the frost and ice from the heat exchanger to insure reliable and efficient operation of the heat pump system. If insufficient frost and ice are melted, the defrost cycle will repeat too frequently, wasting energy. If each defrost cycle continues for too long, the repetition rate is reduced, but again energy is wasted. The present invention seeks to optimize these two considerations while insuring reliable operation of the heat pump.

The numerical constants disclosed in the equations presented in the flow chart of FIG. 3 were determined for a particular design of heat pump system and outdoor heat exchanger. It should be apparent to one skilled in the art that the values presented in the equations may not be optimal for all such heat pumps and designs of heat exchangers and must therefore be determined experimentally for each system.

Although the present invention has been disclosed in a preferred embodiment utilizing a microcomputer, it is also possible that the invention could be carried out using hardware logic and discrete components, or by using a more sophisticated digital computer. Furthermore, while the present invention has been described with respect to a preferred embodiment, it is to be understood that modifications thereto will become apparent to those skilled in the art, which modifications lie within the scope of the present invention, as defined in the claims which follow.

We claim:

1. In an air source heat pump for temperature conditioning a comfort zone, including an outdoor heat exchanger, an indoor heat exchanger, a compressor connected to a reversing valve by a refrigerant suction line, and means for moving air through the outdoor and indoor heat exchangers in heat transfer relation therewith, a control for defrosting the outdoor heat exchanger to melt ice and frost accumulated thereon during operation of the heat pump in a heating mode, said control comprising (a) a sensor for sensing the temperature in the comfort zone;

(b) a suction line temperature sensor;

(c) a sensor for sensing the temperature of outdoor ambient air; and (d) control means responsive to the suction line, comfort zone, and outdoor ambient air temperature sensors, and operative to determine as a continuous function of the magnitude of the temperatures of the comfort zone, the suction line, and the outdoor ambient air, the maximum permissible degradation of heat transfer in the outdoor heat exchanger at which the defrost cycle should be initiated to optimize the efficiency and reliability of the heat pump and operative to initiate the defrost cycle accordingly.

2. The control of claim 1 wherein the control means are operative to maintain a substantially constant maximum permissible degradation of heat transfer efficiency as the comfort zone temperature changes, whereby the difference between suction line temperature and the outdoor ambient air temperature at which the control means initiate the defrost cycle, changes in inverse proportion to the comfort zone temperature.

3. In an air source heat pump for temperature conditioning a comfort zone, including an outdoor heat exchanger, an indoor heat exchanger, a compressor connected to a reversing valve by a refrigerant suction line, and means for moving air through the outdoor and indoor heat exchangers in heat transfer relation therewith, a control for defrosting the outdoor heat exchanger to melt ice and frost accumulated thereon during operation of the heat pump in a heating mode, said control comprising (a) a sensor for sensing the temperature in the comfort zone;

(b) an outdoor heat exchanger temperature sensor;

(c) a sensor for sensing the temperature of outdoor ambient air; and (d) control means responsive to the outdoor heat exchanger, comfort zone, and outdoor ambient air temperature sensors, and operative to determine, as a continuous function of the magnitude of the temperatures of the comfort zone, the outdoor heat exchanger, and the outdoor ambient air, the maximum permissible degradation of heat transfer in the outdoor heat exchanger at which the defrost cycle should be initiated to optimize the efficiency and reliability of the heat pump, and operative to initiate the defrost cycle accordingly.

4. The control of claim 3 wherein the control means are operative to maintain a substantially constant maximum permissible degradation of heat transfer efficiency as the comfort zone temperature changes, whereby the difference between the outdoor heat exchanger temperature and outdoor ambient air temperature at which the control means initiate the defrost cycle changes in inverse proportion to the comfort zone temperature.

5. A control for defrosting an outdoor heat exchanger of an air source heat pump for temperature conditioning a comfort zone, wherein the heat pump includes a refrigerant vapor compressor, an indoor heat exchanger, a reversing valve connected to the compressor inlet by a suction line, an indoor fan, and an outdoor fan, said control comprising (a) a comfort zone temperature sensor;

(b) a suction line temperature sensor;

(c) an outdoor ambient air temperature sensor;

(d) an outdoor heat exchanger temperature sensor; and (e) control means, responsive to the comfort zone, suction line, outdoor ambient air, and outdoor heat exchanger temperature sensors and operative to initiate a defrost cycle to melt frost and ice accumulated on the outdoor heat exchanger during its operation as an evaporator, if i) the outdoor ambient air temperature exceeds a value determined by the control means as a function of the indoor temperature and one of the outdoor heat exchanger or suction line temperatures, and ii) said one of the outdoor heat exchanger or suction line temperatures is less than a predetermined maximum limit and greater than a predetermined minimum limit; whereby said control means thereby determine, as a function of the comfort zone temperature, the maximum permissible degradation of heat transfer in the outdoor heat exchanger at which the defrost cycle should be initiated to optimize the efficiency and reliability of the heat pump.

6. The control of claims 1, 3, or 5 wherein the control means are operative to terminate the defrost cycle after a predetermined time interval has elapsed.

7. The control of claims 3, or 5 wherein the control means are operative to terminate the defrost cycle if the outdoor heat exchanger temperature exceeds a value determined by the control means as a function of the outdoor ambient air temperature, whereby the defrost cycle is terminated after sufficient frost is melted from the outdoor heat exchanger to insure adequate time between successive defrost cycles to optimize the efficiency and reliability of the heat pump.

8. The control of claims 1, 3, or 5 wherein the control means initiate the defrost cycle by deenergizing the outdoor fan, and causing the reversing valve to interchange the function of the outdoor and the indoor heat exchangers, so that the outdoor heat exchanger is supplied with hot refrigerant vapor which is condensed by heat transfer with the frost and ice accumulated thereon, and is thereby defrosted.

9. The control of claim 5, wherein said control means are operative to initiate the defrost cycle at a relatively constant level of heat transfer degradation as the comfort zone temperature changes; and wherein the control means are operative to select the suction line temperature as said one of the outdoor heat exchanger and suction line temperatures if the outdoor heat exchanger temperature exceeds the suction line temperature by more than a predetermined amount; and otherwise, are operative to select the outdoor heat exchanger temperature as said one temperature.

10. In an air source heat pump for temperature conditioning a comfort zone, including an outdoor heat exchanger, an indoor heat exchanger, a compressor connected to a reversing valve by a refrigerant suction line, and means for moving air through the outdoor and indoor heat exchangers in heat transfer relation therewith, a method for defrosting the outdoor heat exchanger to melt ice and frost accumulated thereon during operation of the heat pump in a heating mode, said method comprising the steps of:

(a) sensing the temperature in the comfort zone;

(b) sensing the suction line temperature;

(c) sensing the temperature of outdoor ambient air; and (d) determining as a continuous function of the magnitude of the temperatures of the comfort zone, the suction line and the outdoor ambient air, the maximum permissible degradation of heat transfer in the outdoor heat exchanger at which the defrost cycle should be initiated to optimize the efficiency and reliability of the heat pump; and initiating the defrost cycle accordingly.

11. The method of claim 10 wherein the maximum permissible degradation of heat transfer efficiency remains substantially constant as the comfort zone temperature changes, whereby the difference between the suction line temperature and outdoor ambient air temperature at which the defrost cycle is initiated changes in inverse proportion to the comfort zone temperature.

12. In an air source heat pump for temperature conditioning a comfort zone, including an outdoor heat exchanger, an indoor heat exchanger, a compressor connected to a reversing valve by a refrigerant suction line, and means for moving air through the outdoor and indoor heat exchangers in heat transfer relation therewith, a method for defrosting the outdoor heat exchanger to melt ice and frost accumulated thereon during operation of the heat pump in a heating mode, said method comprising the steps of (a) sensing the temperature in the comfort zone;

(b) sensing the outdoor heat exchanger temperature;

(c) sensing the temperature of outdoor ambient air; and (d) determining as a continous function of the magnitude of the temperatures of the comfort zone, the outdoor heat exchanger, and the outdoor ambient air, the maximum permissible degradation of heat transfer in the outdoor heat exchanger at which the defrost cycle should be initiated to optimize the efficiency and reliability of the heat pump; and initiating the defrost cycle accordingly.

13. The method of claim 12 wherein the maximum permissible degradation of heat transfer efficiency remains substantially constant as the comfort zone temperature changes, whereby the difference between the outdoor heat exchanger temperature and outdoor ambient air temperature at which the defrost cycle is initiated changes in inverse proportion to the comfort zone temperature.

14. A method for defrosting an outdoor heat exchanger of an air source heat pump for temperature conditioning a comfort zone, wherein the heat pump includes a refrigerant vapor compressor, an indoor heat exchanger, a reversing valve connected to the compressor inlet by a suction line, an indoor fan, and an outdoor fan, said method comprising the steps of (a) sensing the comfort zone temperature;

(b) sensing the suction line temperature;

(c) sensing the outdoor ambient air temperature;

(d) sensing the outdoor heat exchanger temperature; and (e) initiating a defrost cycle to melt frost and ice accumulated on the outdoor heat exchanger during its operation as an evaporator, if (i) the outdoor ambient air temperature exceeds a value determined as a function of the indoor temperature and one of the outdoor heat exchanger or suction line temperatures, and (ii) said one of the outdoor heat exchanger or suction line temperatures is less than a predetermined maximum limit and greater than a predetermined minimum limit; determining thereby, as a function of the comfort zone temperature, the maximum permissible degradation of heat transfer in the outdoor heat exchanger at which the defrost cycle should be initiated to optimize the efficiency and reliability of the heat pump.

15. The method of claims 10, 12, or 14, further comprising the step of terminating the defrost cycle after a predetermined time interval has elapsed.

16. The method of claims 12, or 14, further comprising the step of terminating the defrost cycle if the outdoor heat exchanger temperature exceeds a value determined as a function of the outdoor ambient air temperature, whereby the defrost cycle is terminated after sufficient frost is melted from the outdoor heat exchanger to insure adequate time between successive defrost cycles to optimize the efficiency and reliability of the heat pump.

17. The method of claims 10, 12, or 14 wherein the step of intiating the defrost cycle includes the steps of de-energizing the outdoor fan, and causing the reversing valve to interchange the function of the outdoor and the indoor heat exchangers, so that the outdoor heat exchanger is supplied with hot refrigerant vapor which is condensed by heat transfer with the frost and ice accumulated thereon, and is thereby defrosted.

18. The method of claim 14, wherein the defrost cycle is initiated at a relatively constant level of heat transfer degradation, as the comfort zone temperature changes; and further comprising the step of selecting the suction line temperature as said one of the outdoor heat exchanger and suction line temperatures if the outdoor heat exchanger temperature exceeds the suction line temperature by more than a predetermined amount; and otherwise, selecting the outdoor heat exchanger temperature as said one temperature.

19. The control of claim 1 wherein the control means are operative to terminate the defrost cycle if the outdoor heat exchanger temperature exceeds a value determined by the control means as a function of the suction line temperature, whereby the defrost cycle is terminated after sufficient frost is melted from the outdoor heat exchanger to insure adequate time between successive defrost cycles to optimize the efficiency and reliability of the heat pump.

20. The method of claim 10 further comprising the step of terminating the defrost cycle if the suction line temperature exceeds a value determined as a function of the outdoor ambient air temperature, whereby the defrost cycle is terminated after sufficient frost is melted from the outdoor heat exchanger to insure adequate time between successive defrost cycles to optimize the efficiency and reliability of the heat pump.

* * * * *